US005127210A

United States Patent [19]

Jensen

[11] Patent Number: 5,127,210

[45] Date of Patent: Jul. 7, 1992

[54] DART STORAGE AND TRANSPORT APPARATUS AND METHOD

[76] Inventor: Edward A. Jensen, 5936 S. Blue Iron Way, Kearns, Utah 84118

[21] Appl. No.: 760,673

[22] Filed: Sep. 16, 1991

Related U.S. Application Data

[62] Division of Ser. No. 679,878, Apr. 3, 1991, Pat. No. 5,067,610.

[51] Int. Cl.[5] ..... B65B 5/08; B65B 5/10; B65B 7/28; B65B 25/00

[52] U.S. Cl. ..... 53/467; 53/468; 53/474; 53/475; 53/492; 414/411

[58] Field of Search ..... 53/492, 472, 474, 467, 53/468, 169, 381.4, 484; 414/411; 206/579

[56] References Cited

U.S. PATENT DOCUMENTS

| | | | |
|---|---|---|---|
| 2,682,138 | 6/1954 | Sax | 53/169 X |
| 2,964,166 | 12/1960 | Lehner et al. | 206/579 |
| 3,960,271 | 6/1976 | Nelson | 206/315.1 |
| 4,002,236 | 1/1977 | Tolleson | 206/579 X |
| 4,105,119 | 8/1978 | Cowan | 206/579 |
| 4,133,427 | 1/1979 | Loomis | 206/579 X |
| 4,773,578 | 9/1988 | Braun | 206/315.1 |
| 4,845,923 | 7/1989 | Donovan | 53/474 X |
| 4,875,579 | 10/1989 | Tak | 206/579 X |
| 5,050,740 | 9/1991 | Lucero | 206/579 |

FOREIGN PATENT DOCUMENTS

| | | | |
|---|---|---|---|
| 1342597 | 1/1974 | United Kingdom | 206/315.1 |
| 1429798 | 3/1976 | United Kingdom | 206/315.1 |
| 2225569 | 6/1990 | United Kingdom | 206/315.1 |

*Primary Examiner*—Horace M. Culver
*Attorney, Agent, or Firm*—Lynn G. Foster

[57] ABSTRACT

A novel carrier for darts and dart parts. Each carrier comprises storage for a plurality of darts plus compartments for safely storing replacement feathers. tips, and weights. Protection is provided for both the user and each dart as darts are stored tip first into a blind bore in the carrier. Compression springs in the blind end of the bore provide, first, protection for the tip and, second, controlled ejection force whereby each dart is partially ejected when a holding cover is removed such that darts can be removed from the carrier without damage to feathers at the rear of each dart. Grooves and recesses are provided to protect each dart feather while in the carrier. The carrier comprises storage compartments whereby dart parts are stored separately to minimize damage to fragile parts, such as the feathers. Part and dart containing covers are easily emplaced and provide containment surfaces whereby the contents of the carrier are stored and transported without fear of damage or loss.

11 Claims, 5 Drawing Sheets

DART STORAGE AND TRANSPORT APPARATUS AND METHOD

This application is a division of my co-pending U.S. patent application Ser. No. 07/679,878 filed Apr. 3, 1991, now U.S. Pat. No. 5,067,610.

FIELD OF THE INVENTION

This invention relates to apparatus appertaining to games of darts and more specifically to carriers for the storage and transportation of darts.

BACKGROUND AND DESCRIPTION OF RELATED ART

Darts began as a predominantly British game played by throwing darts at a circular numbered board. In each game, a player generally uses three darts. According to the Encyclopedia Britannica, there were reports of darts being thrown at a marked quintain, a tournament practice target, as a game in early English history. Darts are recorded as a pastime of the Pilgrim Fathers on board the Mayflower in 1620. In its modern form in England, the game is more often played in a public house (a tavern or club). At the beginning of the 1960's the number of players in the British Isles was estimated to be 6,000,000 of whom 1,000,000 were registered players of 7,000 clubs affiliated with the National Darts Association. More recently, darts have become a popular sport in the United States.

With the application of modern technology, darts are now made in assembleable parts comprising interchangeable shafts, feathers, weights, and tips as the game of darts takes on a more modern sporting tenor. In high technology darts, where the tips are often razor sharp and the feathers made with exacting precision, protection for the user and for the damageable parts of the darts in storage and transport is of concern. Further, there is a need to transport spare, replacement parts as well.

BRIEF SUMMARY AND OBJECTS OF THE INVENTION

In brief summary, this invention alleviates all of the known problems related to carrying and storing darts and replacement parts for darts. The invention comprises a carrier for storing a plurality of darts and compartments for safely storing replacement flights or feathers, tips, and weights. Novel protection is provided for both the user and each dart as darts are stored tip first into a blind bore in the carrier. A compression spring in the blind end of each bore provides, first, protection for each dart tip and, second, a controlled ejection force whereby the dart is partially ejected when a holding cover is removed. Thereby, darts are safely removed from the carrier without damage to flights or feathers attached at the rear of each dart. Additionally, grooves and recesses in the carrier are provided to protect the flights or feathers on each dart stored therein. The carrier comprises separate storage compartments whereby dart parts are stored separately to minimize damage to fragile parts, such as the feathers. Part and dart retaining covers are easily emplaced and provide containment surfaces such that the contents of the carrier are stored and transported without fear of damage or loss.

Accordingly, it is a primary object to provide a carrier for storing and transporting a plurality of darts.

It is a further primary object to provide a dart carrier which provides user safe insertion of darts.

It is an important object to provide a dart carrier which protects dart tips during insertion, removal, storage and transport.

It is another important object to provide a carrier which is assembled using at least to pairs of identical parts.

It is a further important object to provide a dart carrier which protects dart feathers during insertion, removal, storage and transport.

It is a still further important object to provide at least one compartment whereby fragile replacement parts such as dart feathers are separately and safely stored.

It is another further important object to provide compartments for all dart replacement parts.

It is another important object to provide an easily removable cover which retains parts within the carrier during storage and transport.

It is another primary object to provide dart ejection apparatus which stores energy when the dart is fully inserted for storage in the carrier and provides controlled, limited ejection of the dart for easy removal when the retaining cover is removed for access to the darts.

These and other objects and features of the present invention will be apparent from the detailed description taken with reference to accompanying drawings.

DETAILED DESCRIPTION OF THE ILLUSTRATED EMBODIMENTS

Figure 1:
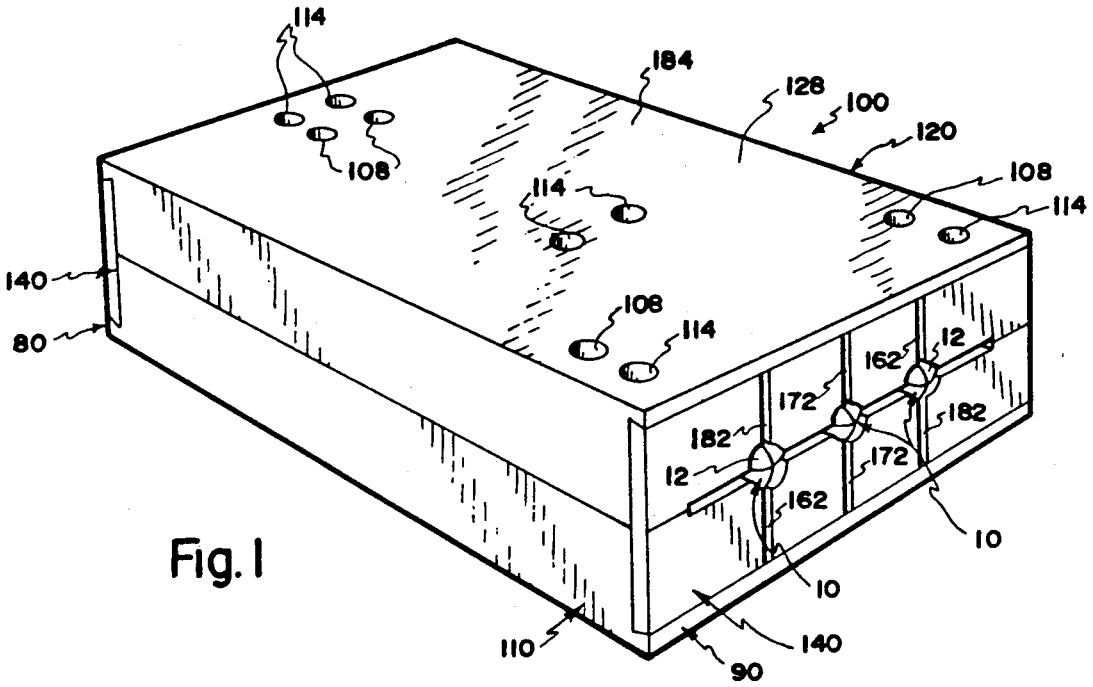
FIG. 1 is a perspective of a dart carrier showing the dart insertion end of the carrier.

In this description, the term proximal is used to indicate the segment of the device normally closest to the operator when it is being used. The term distal refers to the other end. Reference is now made to the embodiments illustrated in FIGS. 1-12 wherein like numerals are used to designate like parts throughout. As seen in FIG. 1, one currently preferred embodiment of the invention comprises a carrier 100 which provides a safe housing for transporting and storing darts 10. The main body of carrier 100 is formed by an inferiorly positioned segment 110 and a superiorly positioned segment 120.

Access is available at each end of carrier 100 by removing a slidably emplaced cover 140.

In the perspective of FIG. 1, the dart 10 insertion end 90 of carrier 100 is proximal to the viewer. A plurality of darts 10 are seen contained within carrier 100 through a transparent cover 140, although the cover may be translucent or opaque. In combination, segments 120 and 110 provide a series of grooves and recesses for storing and protecting dart feathers 12, as described in more detail later.

Figure 2:
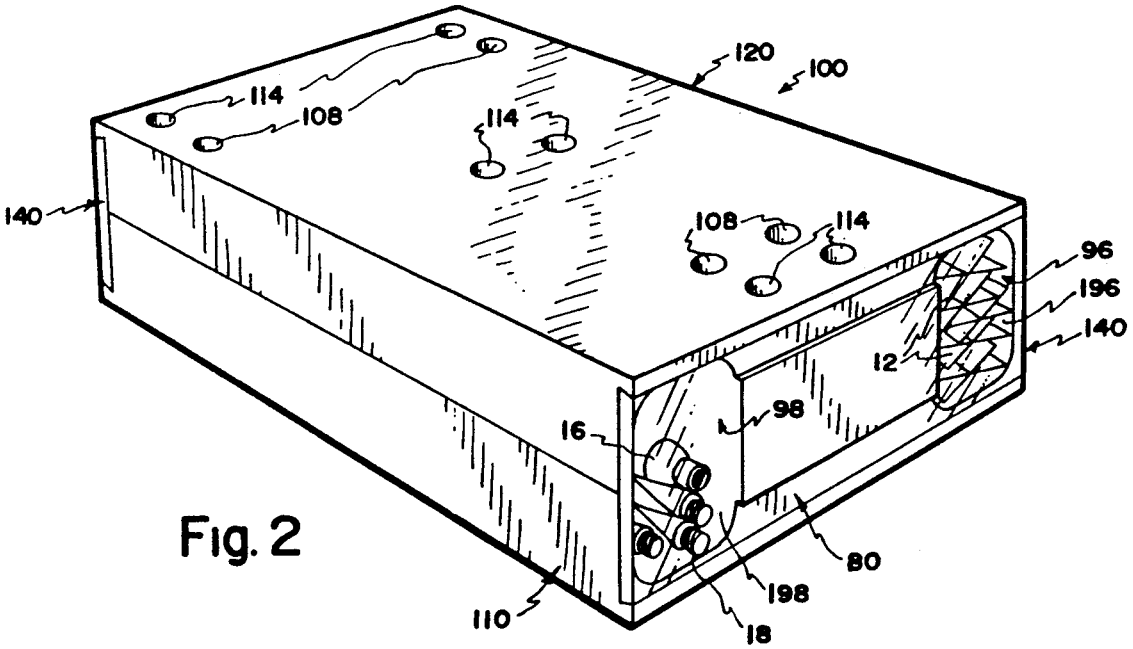
FIG. 2 is a perspective of a dart carrier showing an end which comprises storage compartments for replacement dart parts.

An opposite hand perspective of carrier 100 is seen in FIG. 2 where proximally viewed end 80 comprises a compartment 96 which is shown being used to provide storage for dart feathers 12. On the other side of carrier 100, a second compartment 98 is providing storage for dart tips 18 and at least one weight 16. Compartments 96 and 98 are seen through a transparent cover 140, which is identical to the cover 140 of FIG. 1.

Figure 3:
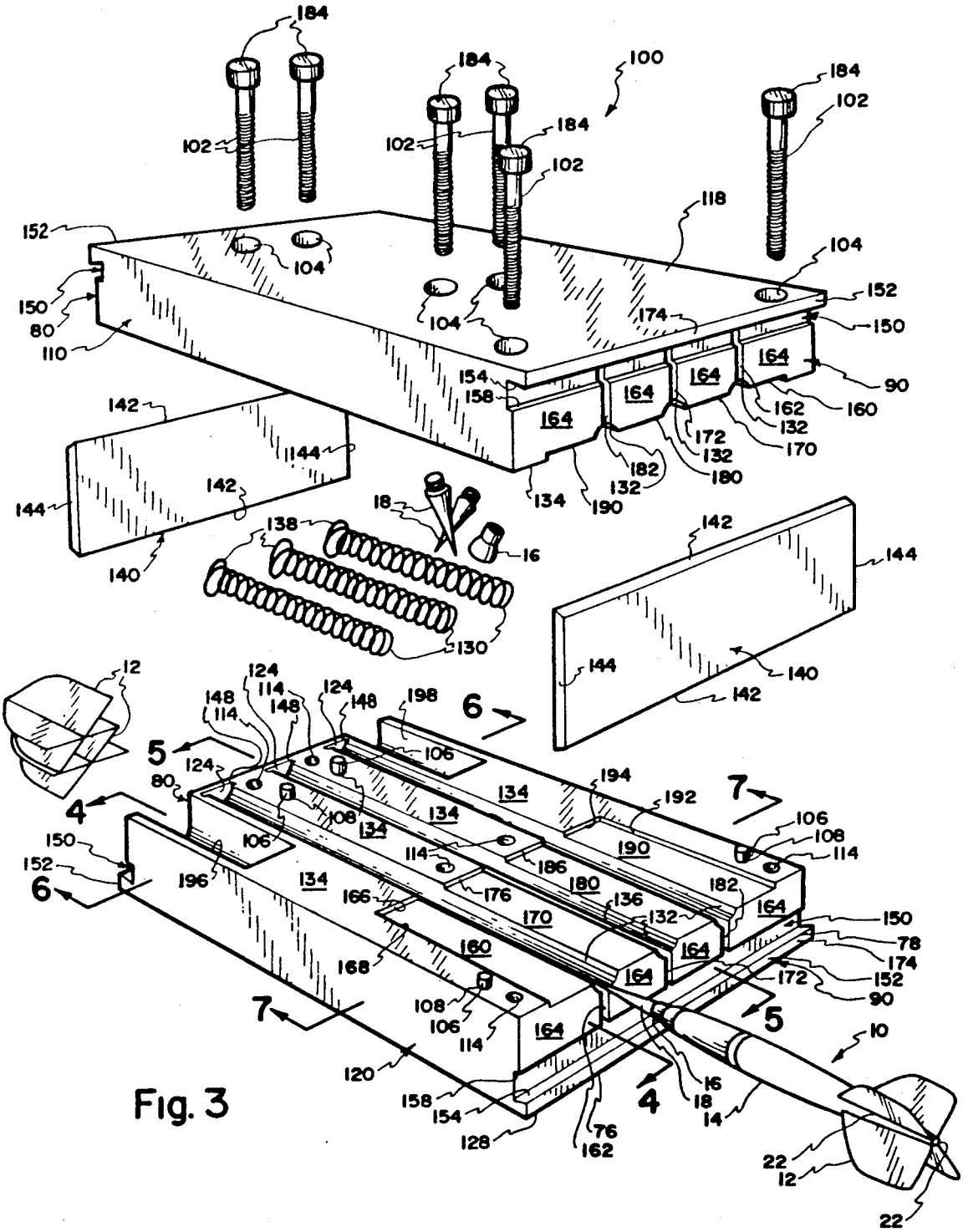
FIG. 3 is an exploded view of a first currently preferred embodiment of the carrier with one dart and some replacement parts provided for clarity of use.

A more detailed view of carrier 100 is seen in FIG. 3. As seen in FIG. 3, carrier 100 is inverted and exploded to more clearly show previously inferiorly positioned segment 110 in FIGS. 1 and 2 as the top or upper segment. Superiorly positioned segment 120 of FIGS. 1 and 2 is the bottom or lower segment in FIG. 3. Carrier 100 comprises segment 110, segment 120, two end covers 140, six connecting bolts 102, and three compression springs 130.

Also seen in FIG. 3 are spare or replacement parts representing items which may be stored in carrier 100. A dart 10 is seen in proximal position relative to carrier 100. Though darts may vary in design, each dart 10 may be considered to comprise a tip 18, a weight 16, a shaft 14, and feathers 12. In the dart seen in FIG. 3, feathers 12 are inserted into orthogonal grooves 22 in the proximal end of shaft 14 and are removable and replaceable therefrom. Commonly, the other parts are tapped and threaded for ready replacement and repair. In dart 10 as seen in FIG. 3, each tip 18, weight 16, shaft 14, and feathers 12 are separable; however, other darts may be used wherein some of these parts are inseparably joined.

Parts, other than those seen in combination in dart 10 and which are storable in compartments 96 and 98, comprise unattached feathers 12, tips 18 and weights 16 seen in the plane of springs 130 in FIG. 3. Different feathers 12, tips 18, and weights 16 can be assembled on a shaft 14 providing repair parts or a dart 10 which will fly a different trajectory.

The main body of carrier 100 is formed of two nearly identical segments, 110 and 120. For this reason, only segment 120 is described in detail. The elemental differences between segment 110 and 120 are disclosed in detail later. Segment 120 comprises a part which may be synthetic resinous material formed by machining or molding. As seen in FIG. 3, segment 120 comprises a series of recesses, depressions and cavities formed in a medial surface 134 such that when segment 120 is placed in contact with segment 110 matching recesses, depressions and cavities form compartments, bores, and grooves for each stored dart 10 and component parts, comprising feathers 12, tips 18, and weights 16.

As seen in FIG. 3, segment 120 comprises a centrally disposed semi-circular bore 136 which extends from a proximal side surface 164 along surface 134 to a blind end 124. The diametral measure of bore 136 is greater than the diameter of a dart shaft 14. As seen in FIG. 3, bore 136 is one of a plurality of bores, generally designated 132. The length of bore 136 is of sufficient length that the distal tip 18 of a dart 10, oriented as seen in FIG. 3 and placed into a bore 132 such that the proximal edge of feathers 12 are distal to proximal edge 164, is substantially proximal from blind end 124.

Segment 120 is symmetrical about a vertical plane through the long axis of bore 136. On each side of bore 136, another identical bore 132 is placed parallel, but apart from bore 136 a distance such that no feather 12 of one dart 10 touches a shaft 14 of another dart 10 when the darts are stored in adjacent bores 132. A planar recess is cut into a proximal portion of surface 134 forming longitudinal edges 168 and 192, cross-edges 166, 176, 186, and 194, and planar surfaces 160, 170, 180, and 190. Surfaces 160, 170, 180, and 190 are parallel to surface 134. The length of each surface 160, 170, 180, and 190 is longer than the length of each feather 12. Edges 168, 166, 176, 186, 194, and 192 each have a width at least as wide as a feather 12. The shortest distance between a circumferential edge of a bore 132 and either edge 168 or 192 is longer than the width of a feather 12, thereby providing clearance for a feather 12 to lie unobstructed on either surface 160 or 190.

Figure 4:
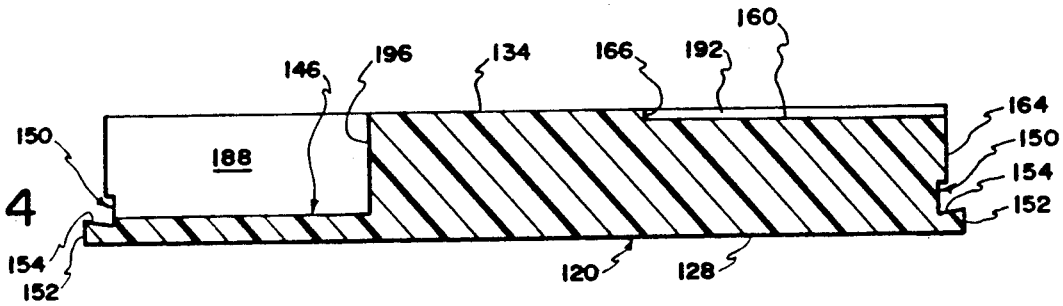
FIG. 4 is a section along lines 4—4 of FIG. 3.
Figure 6:
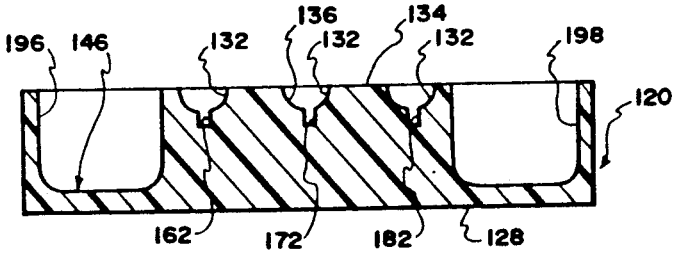
FIG. 6 is a section along lines 6—6 of FIG. 3.

Each distal corner of segment 120 comprises an identical cavity, 196 and 198. Therefore, only cavity 196 is described in detail. As best seen in FIGS. 6, cavity 196 comprises a deep "U" shaped blind bore 146. The length and longitudinal position of "U" shaped bore 146 is best seen in FIG. 4. "U" shaped bore 146 is sufficiently wide and deep to accept feathers 12 without bending and to completely encompass at least one tip 18 and weight 16 (see FIGS. 2 and 3).

Figure 5:
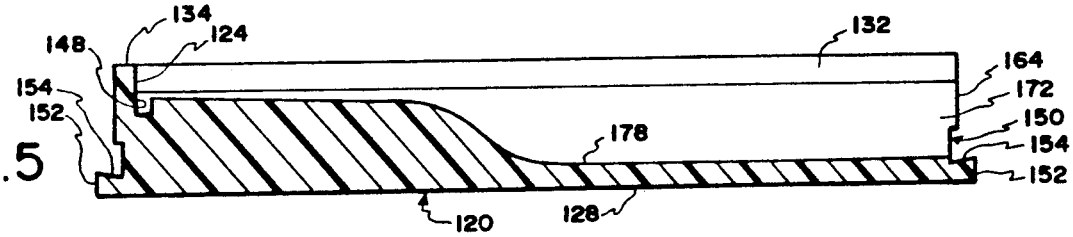
FIG. 5 is a section along lines 5—5 of FIG. 3.
Figure 7:
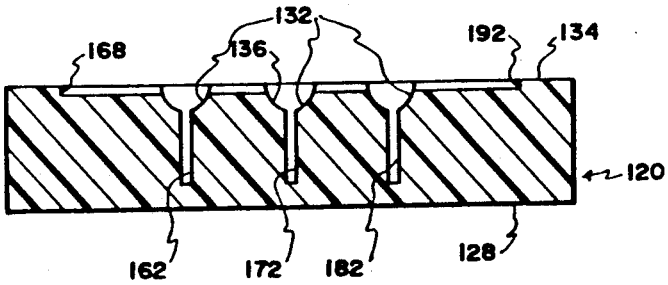
FIG. 7 is a section along lines 7—7 of FIG. 3.

Referring again to FIG. 3, segment 120 comprises a plurality of vertical grooves, designated 162, 172, and 182, one of which extends vertically downward from each bore 132. An outline of the base 178 of vertical groove 172 is seen in FIG. 5. Base 178 accurately traces a path which provides a shallow groove near blind end 124 and significantly deeper groove at the other end where each groove provides passage for a feather 12. The breadth of each groove 162, 172, and 182 is therefore greater than the thickness of a feather 12 but significantly narrower than the diameter of bore 132. The length and position of the wider portions of each groove 162, 172, and 182, as seen in FIGS. 5 and 7, is greater than the width of a feather 12 in more proximal areas where a feather 12 will be inserted as an associated dart 10 is inserted in bore 132.

In this currently preferred embodiment, segment 110 is joined to segment 120 by bolting the two segments together, although other methods of joining the two segments may be used such as by bonding with a suitable adhesive, which is well known in the art. As noted earlier, with a number of exceptions to be enumerated hereafter, segment 110 is an image of segment 120 rotated 180° about the long axis of bore 136. Each segment 110 and 120 comprises a plurality of juxtaposed and aligned holes 104 and 114, respectively, for attachment bolts 102. Each hole 104 is countersunk such that the top edge 184 of an inserted and tightened bolt 102 is flush with the top surface 118 of segment 110 when segment 110 is joined to segment 120.

No hole 104 or 114 coincides with a cavity 196 or 198 or with a bore 132 or with a planar surface 160, 170, 180, or 190. The holes are placed symmetrically about the longitudinal axis of bore 136 such that compressive stresses are evenly distributed. In segment 110, the segment which receives the top 184 of each bolt 102, the smaller diameter of bore hole 104 is slightly larger than the outside diameter of bolt 102 whereby the shaft of each bolt 102 passes freely therethrough. One difference between segment 110 and segment 120 is the difference in size between the inner diameters of each respectively aligned bolt hole 104 and bolt hole 114. Segment 120 bolt holes 114 are smaller than holes 104. The bore of each hole 114 is tapped to threadably accept and retain an inserted bolt 102.

In another preferred embodiment, each hole 114 is made identical with hole 104 and retention of each bolt 102 is accomplished by means of a nut inserted into the countersunk portion of the hole on the side opposite the top edge 184 of each bolt 102, thereby providing a more uniform design between segments 110 and 120 and a surface free of exposed nuts and bolts on surfaces, 118 and 128, respectively.

Segment 110 and 120 are precisely aligned, when joined, by alignment pins. In the currently preferred embodiment, when segments 110 and 120 are first joined, alignment holes 106 are drilled through the superior side 128 of segment 120 as seen in FIG. 1 and continued therethrough to at least partially drill holes 106 through inferiorly positioned segment 110. Drilled alignment holes in segment 110 are not shown, but accomplishment of such is well known in the art. Tight-fitting alignment pins 108 are place into holes 106 and therethrough into corresponding holes in segment 110, such that the preferred orientation of segment 110 to segment 120 is realized and maintained each time the two are joined. Holes 106 are drilled completely through segment 120 while the corresponding holes in segment 110 are only partially drilled through, providing another element of difference between segments 110 and 120. However, all alignment holes can be drilled or, alternatively, partially drilled through each respective segment 110 and 120, in like fashion, to eliminate this element of difference. Making each alignment hole and bolt hole in one segment (such as segment 110) identical with a juxtaposted hole in the other segment (such as segment 120) makes the two segments identical.

When assembled as seen in FIG. 1, each semicircular bore 132 combines with a corresponding semicircular bore 132 to form a circular bore into which the tip 18, weight 16 and then shaft 14 of a dart 10 are inserted for storage and/or transport. Grooves 162, 172, 182, 192 and grooves formed between planar surfaces 160, 170, 180, and 190 provide spaces for safe insertional travel of each dart's feathers 12 when inserted therein.

To provide protection for the tip 18 of each dart 10 and also to provide a storage of energy whereby a released dart 10 is partially ejected from carriage 100 such that each dart 10 is easily removed from carriage 100 without harm to a feather 12, a compressible spring 130 is placed in each bore 132. The internal diameter of each compressible spring is less than the diameter of shaft 14 and greater than the diameter of tip 18. Each spring 130 comprises an end loop 138 of expanded diameter. At the blind end 124 of each bore 132, a semicircular groove 148 of a diameter which will accept loop 138 is placed. Before segment 110 is joined to segment 120, a spring 130 is placed in each bore 132 such that loop 138 lies in a groove 148 and spring 130 is thereby retained in position in bore 132 after the segments are joined. The compressed length of each compressible spring 130 is longer than a tip 18, thereby protecting the end of each tip 18 when a dart 10 compressibly engages spring 130.

At each end of each segment 110 and 120, is a planar surface 164 which is normal to inner surfaces 134, 160, 170, 180, and 190. Extending beyond each surface 164, thereby extending surfaces 118 and 128 at each end, is a tongue 152 as best seen in FIG. 3. On one side, a surface of each tongue 152 is an extension of a corresponding surface 118 or 128 to an end surface 174. Surface 174 is normally connected to associated surface 118 or 128 on one long edge 76. On the other long edge 78 of surface 174, an acute angle is formed with a planar surface 154 thereby forming each tongue 152. A pair of juxtaposed tongues 152, one extending from surface 118 and the other extending from surface 128, act in combination to hold a slidably inserted cover when segments 110 and 120 are joined. A groove 150 comprising surface 154 and another edge surface 158 provides a surface continuum which connects each tongue 152 to associated surface 164.

Proximal cover 140, best seen in FIGS. 1 and 3, is used to retain each dart 10 within an associated bore 132 in carrier 100. Another identical cover 140 confines parts stored in compartments 96 and 98 at the other side of the assembled carrier 100 seen in FIG. 2. Each cover 140 slidably attaches to an end of carrier 100 as seen in FIGS. 1 and 2.

As better seen in FIG. 3, each cover 140 is rectangular and comprises a square cut short side 144 and a beveled long side 142. The length of long side 142 is the same as the length of tongue 152. The bevel of long side 142 is made to be parallel to each associated edge 154 when carrier 100 is assembled and cover 140 is resident therebetween. The length of short side 144 is less than the distance between opposite edges 154, but of sufficient length that the cover cannot be removed from a position between edges 154 in a direction normal to surface 164.

Figure 12:
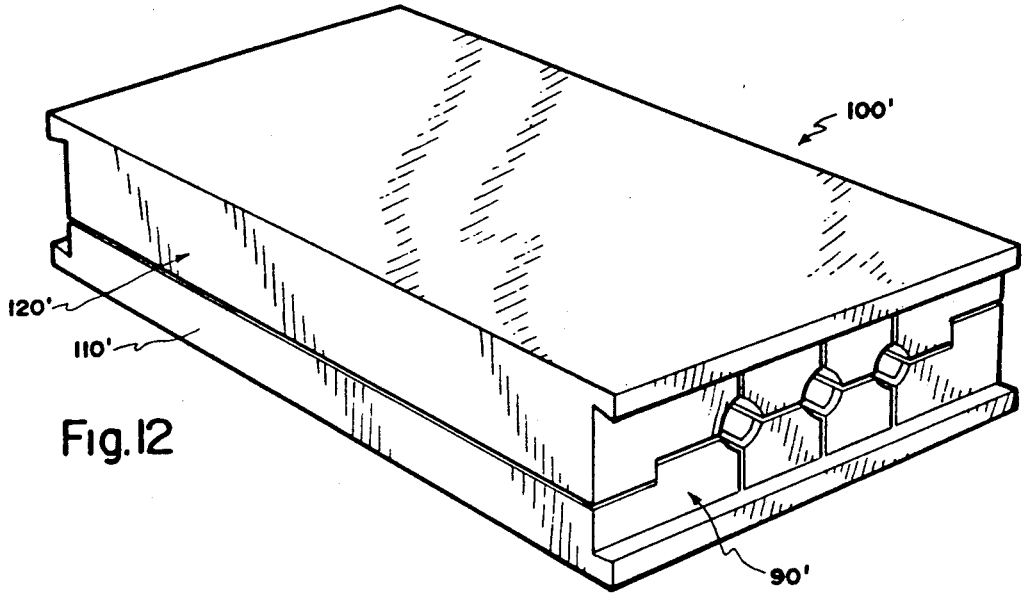
FIG. 12 is an assembled perspective of the carrier of FIG. 8.

Another currently preferred embodiment of the invention is seen in FIG. 12. This embodiment comprises a carrier 100' which provides a safe housing for transporting and storing darts 10. The main body of carrier 100' is formed by an inferiorly positioned segment 110' and a superiorly positioned segment 120'. In this embodiment segment 110' is identical to segment 120', but rotated 180° and disposed upon segment 120' to form carrier 100'. Access is available at each end of carrier 100' by removing slidably emplaced cover 140, similar to access of carrier 100.

In the perspective of FIG. 12, the dart 10 insertion end 90' of carrier 100' is proximal to the viewer. Although cover 140 is also used to contain one or more darts within carrier 100', as cover 140 does for carrier 100, no cover 140 is seen in FIG. 12. In combination, segments 120' and 110' provide a series of grooves and recesses for storing and protecting dart feathers 12, in similar manner to the protection provided by carrier 100.

Figure 8:
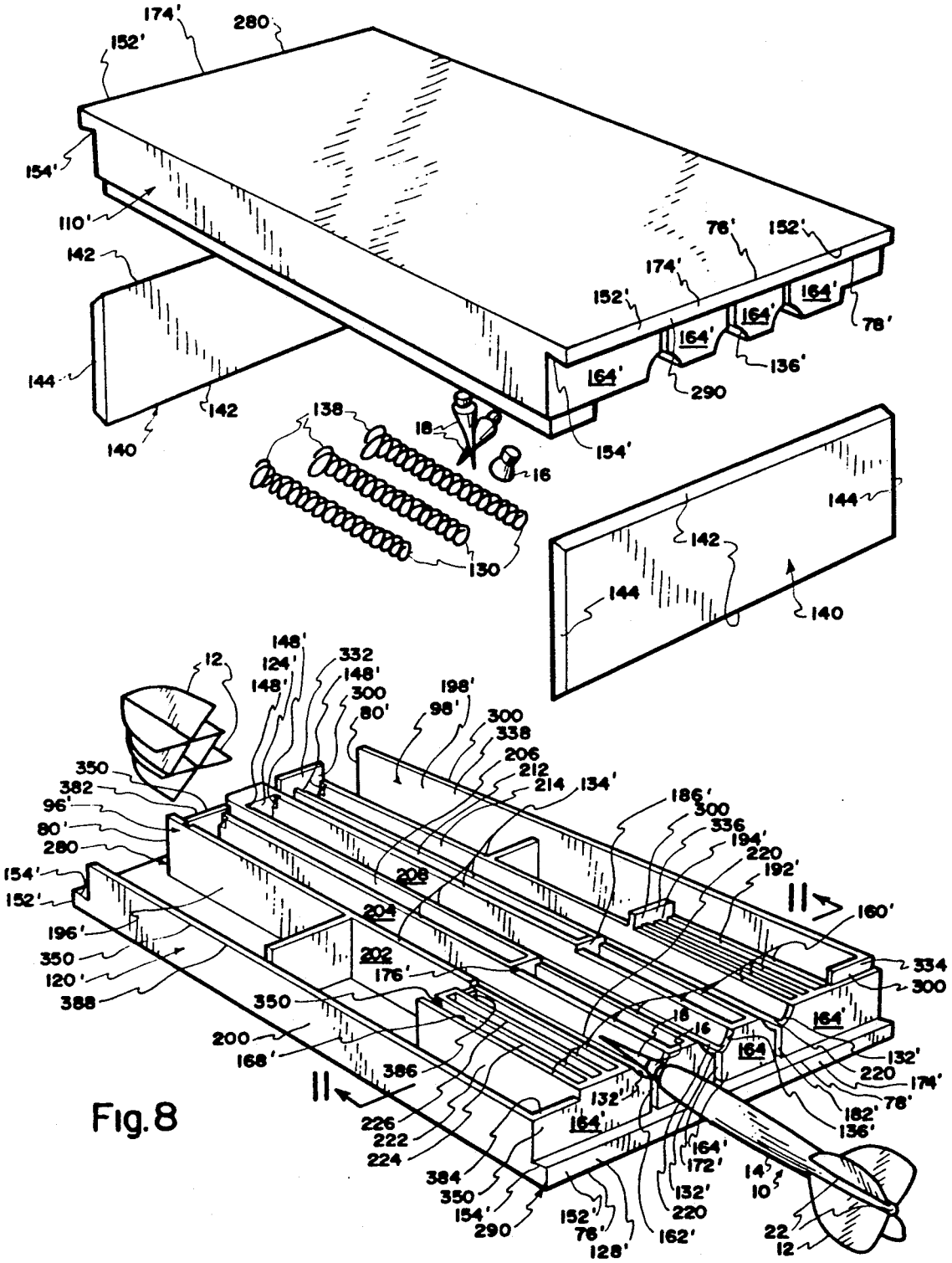
FIG. 8 is an exploded view of a second currently preferred embodiment of the carrier with a dart and a plurality of replacement parts seen therewith.

As seen in FIG. 8, each segment 120' and 110' comprises essentially half of a compartment 96' at end 80' which is used to provide storage for dart feathers 12 as compartment 96 of carrier 100 is used. On the other side of each segment 110' and 120', a second compartment 98' provides substantially the same storage for dart tips 18 and weights 16 as compartment 98 of carrier 100. A cover 140 is also used to cover and contain contents placed in compartments 96' and 98' in similar manner by which contents are contained in compartments 96 and 98.

A more detailed view of carrier 100' is seen in FIG. 8. As seen in FIG. 8, carrier 100' is inverted and exploded to more clearly show previously inferiorly positioned segment 110' as the top or upper segment. Superiorly positioned segment 120' is the bottom or lower segment in FIG. 8. Carrier 100' comprises segment 110', segment 120', two end covers 140, and three compression springs 130.

Also seen in FIG. 8 are spare or replacement parts representing items which may be stored in carrier 100'. A dart 10 is seen in proximal position relative to carrier 100'. Parts, other than those seen in combination in dart 10 and which are storable in compartments 96' and 98', comprises unattached feathers 12, tips 18 and weights 16 seen in the plane of springs 130 in FIG. 8.

The main body of carrier 100' is formed of two identical segments, 110' and 120'. For this reason, only segment 120' is described in detail. Segment 120' comprises a part which may be made of synthetic resinous material formed by machining or molding processes which are known and available in the art. As seen in FIG. 8, segment 120' comprises a series of recesses, depressions and cavities formed in a medial plane 134' formed, in combination, by a segment of the top surface of each vertical riser 202, 204, 206, 208, 212 and 214. When segment 120' is placed in contact with segment 110', matching recesses, depressions and cavities form substantially the same compartments, bores, and grooves for each stored dart 10 and component parts, comprising feathers 12, tips 18, and weights 16 in carrier 100' as is provided by carrier 100.

Figure 11:
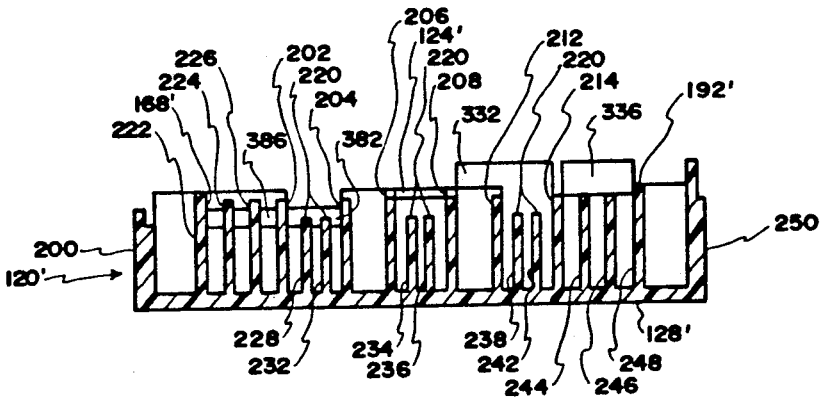
FIG. 11 is a cross-section along lines 11—11 of FIG. 8.

However, carrier 100' comprises a plurality of longitudinally disposed vertical risers disposed on base 128' rather than members which form the solid surfaces 134 and 160 in carrier 100. FIG. 11 provides a cross-sectional view of the longitudinally disposed vertical risers proximal to end 164'.

As seen in FIG. 11 from the viewer's left to right, the longitudinally disposed risers comprise shorts side 200, risers 222, 224, 226, 202, 228, 232, 204, 206, 234, 236, 208, 212, 238, 242, 214, 244, 246, 248, and long side 250. The unfilled space between the longitudinal vertically disposed risers saves material and thereby reduces the weight of carrier 100'. The longitudinally disposed vertical risers rise to variable height above base 128' to provide supporting surfaces which comprise plane 134; plane 160; and dart 10 support plane 220, the purpose of each is described in detail hereafter.

As seen in FIG. 8, segments 110' and 120' comprises a centrally disposed semi-circular bore 136' which extends from a proximal side surface 164' along top surfaces of longitudinally disposed vertical risers 234 and 236 thereby defining plane 220 to a blind end 124. The diametral measure of bore 136' is greater than the diameter of a dart shaft 14. As seen in FIG. 3, bore 136' is one of a plurality of bores, generally designated 132'. The length of bore 136' is of sufficient length that the distal tip 18 of a dart 10, oriented as seen in FIG. 3 and placed into a bore 132' such that the proximal edge of feathers 12 are distal to proximal edge 164', is substantially proximal from blind end 124'.

Except for male and female interconnecting surfaces, segment 120' is symmetrical about a vertical plane through the long axis of bore 136'. On each side of bore 136', another identical bore 132' is placed parallel, but apart from bore 136' a distance such that no feather 12 of one dart 10 touches a shaft 14 of another dart 10 when the darts are stored in bore 136' and in adjacent bores 132'. A planar recess is defined by the proximal height of each longitudinally disposed vertical riser 224, 226, 202, 204, 206, 220, 212, 214, 244 and 246, forming longitudinal edges 168' and 192', cross-edges 176', 186', and 194', and free planar surfaces 160'. Free planar surface 160' is parallel to plane 134'. The area of free planar surface 160' is longer than the length of each feather 12 is thick. Edges 168', 176', 186', 194', and 192' each have a width at least as wide as a feather 12. The shortest distance between a circumferential edge of a bore 132' and either edge 168' or 192' is longer than the width of a feather 12, thereby providing clearance for a feather 12 to lie unobstructed free planar surface 160'.

Each distal corner of segment 120' comprises an identical cavity, 196' and 198'. Each cavity 196' and 198' is essentially identical in internal space and form to each cavity 196 and 198, respectively.

Referring again to FIG. 8, segment 120' comprises a plurality of vertical grooves, designated 162', 172' and 182', one of which extends vertically downward from each bore 132'. Each vertical groove 162', 172', and 182' provides substantially the same function as vertical groove 162, 172 and 182 of carrier 100, except each vertical groove of carrier 100' is formed by two adjacent vertical risers disposed apart such that a feather slides therebetween. Thus the separation of longitudinally disposed vertical riser pairs, 228 and 232, 234, 236, and 244 and 246, comprise grooves 162', 172' and 182', respectively, wherein the feather 12 of a dart 10 is disposed. The breadth of each groove 162', 172' and 182' is therefore greater than the thickness of a feather 12 but significantly narrower than the diameter of bore 132'.

Figure 9:
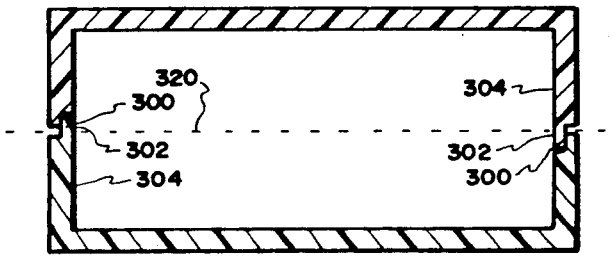
FIG. 9 is a cross-section of a part comprising two joined male/female connections.

In this currently preferred embodiment, segment 110' is joined to segment 120' by a plurality of paired male/female tongue-in-groove connection. In this currently preferred embodiment each tongue-in-groove connection is joined by bonding with adhesives which are known and available in the art. However, compressively joined mechanical attachment and other permanent bonding methods comprising ultrasonic welding are within the scope of the invention. An exemplary male/female tongue-in-groove connection is seen in FIG. 9. As seen therein, each male part 300 comprises an extension along one wall 304; generally wall 304 is an inner wall although it is not so restricted within the overall scope of the invention.

Figure 10:
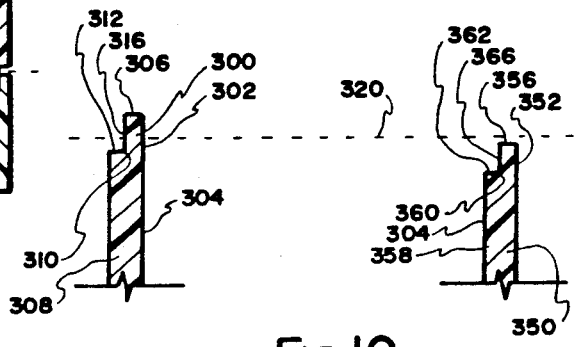
FIG. 10 is a fragmentary cross-section wherein a single male connecting part and a single female connecting part are seen.

As seen in FIG. 10, male part 300 extends beyond the center plane 320 where segments 110' and 120' join. The joining edge 806 of male part 300 is normal to wall 304 and approximately half the width of the wall segment 308 comprising wall 304. On the side 316 of wall segment 308 opposite wall 304, male part 300 extends across center plane 320 to a point 310 which is disposed across center plane 320 from joining edge 306. From point 310 a rim 312 connects male part 300 to wall 314 opposite wall 304.

Female part 350 also comprises an extension, which is disposed along wall 314. Thus wall 314, along which part 350 is extended, is an outer wall in this embodiment, although generally, it is only required the female part be acceptively oriented in female/male connecting relationship with male part 300. As seen in FIG. 10, female part 350 extends along wall 314 opposite wall 304 toward but not coincident with center plane 320. The furthest extension of female part 350 is connected normally to a joining edge 356 which comprises a width approximately one-half as wide as wall segment 358 which is substantially the same width as wall segment 308. On the wall 304 side of wall segment 358, female part 350 extends inferiorly to a point 360 where a rim, 362, normal to wall 304 is disposed between point 360 and wall 304.

Thus, when each male part 300 and each female part 350 are disposed as seen in FIG. 9, each edge 306 is disposed against each associated rim 362 and edge 366 is likewise disposed adjacent edge 316. Before each male part 300 is so disposed against each associated female part 350 an adhesive or bonding agent is applied to at least one surface of each associated rim or edge to permanently affix segment 110' to segment 120'. Such adhesives and bonding agent are known and available in the art.

In this currently preferred embodiment, each male part 300 is disposed in opposite hand relationship about center bore 136' as best seen in FIG. 8. The interconnecting male part 300 comprises distal side male part 338 distal back male part 332, distal front male part 334, and distal medial male part 336. Interconnecting female parts 350 comprise proximal side female part 388, proximal back female part 382, proximal front female part 384, and proximal medial female part 386. Where segment 110' is disposed as seen in FIG. 8 and joined with segment 120', each corresponding male part 332, 334, 336 and 338 is joined to each corresponding female part 382, 384, 386 and 388, respectively.

When assembled as seen in FIG. 12, each semicircular bore

132' combines with a corresponding semicircular bore 132' to form a circular bore into which the tip 18, weight 16 and then shaft 14 of a dart 10 are inserted for storage and/or transport. Grooves 162', 172', 182' and grooves formed each between facing planar surface 160' provide spaces for safe insertional travel of each dart's feathers 12 when inserted therein.

To provide protection for tip 18 of each dart 10 and also to provide a storage of energy whereby a released dart 10 is partially ejected from carriage 100' such that each dart 10 is easily removed from carriage 100' without harm to a feather 12, a compressible spring 130 is placed in each bore 132'. The internal diameter of each compressible spring is less than the diameter of shaft 14 and greater than the diameter of tip 18. As seen in FIG. 8, each spring 130 comprises an end loop 138 of expanded diameter. At the blind end 124' of each bore 132', a segmented semicircular groove 148' of a diameter which will accept loop 138 is placed in similar fashion to placement of loop 138 in groove 148 in carrier 100. Before segment 110' is joined to segment 120', a spring 130 is placed in each bore 132' such that loop 138 lies in a segmented groove 148' and spring 130 is thereby retained in position in bore 132' after the segments are joined. The compressed length of each compressible spring 130 is longer than a tip 18, thereby protecting the end of each tip 18 when a dart 10 compressibly engages spring 130.

At each end of each segment 110' and 120', is a planar surface 164' which is normal to inner planes 134' and 160'. Extending beyond each surface 164', in base 128' is a tongue 152' as best seen in FIG. 8. On one side, a surface of each tongue 152' is an extension of a corresponding base 128 to an end surface 174'. Surface 174' is connected normally to associated base 128 on one long edge 76'. On the other long edge 78' of surface 174', an acute angle is formed with a planar surface 154' thereby forming each tongue 152'. A pair of juxtaposed tongues 152 extending from each opposing end 290 of each segment 110' and 120' act in combination to hold the slidably inserted cover 140 when segments 110' and 120' are joined. At end 290, each tongue 152' is medially joined to associated surface 164'. Tongue 152' at end 280 is identical, but of opposite hand to tongue 152'.

Proximal cover 140, best seen in FIG. 8 is used to retain each dart 10 at end 290 within an associated bore 132' in carrier 100'. Another identical cover 140 confines parts stored in compartments 96' and 98' at end 280 of the assembled carrier 100' in similar manner as compartments 96 and 98 are confined to store like parts in carrier 100. In this currently preferred embodiment, each cover 140 slidably attaches to an end of carrier 100' in the same manner as cover 140 attaches to carrier 100.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all change which come within the meaning and range of equivalency of the claims are therefore intended to be embraced therein.

What is claimed and desired to be secured by Letters Patent is:

1. A method for releasibly disposing at least one dart into a carrier for storage and transport comprising the steps of:

causing a retaining cover of a dart carrier to be placed in an open condition;

advancing a dart into an exposed dart-receiving bore of the open carrier;

forcing the dart during the advancing step inwardly along the bore into engagement with an internal dart ejector counter to a bias thereof;

closing the cover to retain internal imposition of the dart ejector bias upon the dart while so closed.

2. The method according to claim 1 wherein the closing step comprises sliding the cover across the bore in retainer relation with the carrier.

3. The method according to claim 1 wherein the forcing step comprises compressing a spring counter to its memory as the dart is forced into the bore so as to impose the force of the memory upon the dart.

4. The method according to claim 1 wherein the forcing step comprises inserting the dart against a dart ejector spring counter to the memory of the spring so that at all times the dart at a leading tip thereof is spaced from the carrier.

5. A method for retrieving a dart and dart replacement component from a carrier for both comprising the steps of:

causing at least one dart in need of repair to be both disposed in a closed carrier along a first access route and subjected to a memory bias interposed between an inside carrier location and said dart;

opening the carrier, thereby exposing the first access route so that the memory bias displaces and exposes beyond the carrier said dart in need of repair;

exposing a second access route for removal of a dart component disposed in the carrier;

manually grasping and thereby removing said dart along the first access route and acquiring the dart component along the second access route preparatory to a repair of said dart using the dart component.

6. The method according to claim 5 wherein the removing step comprises acquiring a feathered replacement component along the second access route.

7. The method according to claim 5 wherein the removing step comprises acquiring a weighted replacement component along the second access route.

8. The method according to claim 5 wherein the removing step comprises acquiring a replacement tip component along the second access route.

9. A method for removing a dart from a dart carrier comprising the following steps:

causing a dart to be both disposed in a closed carrier and subjected to a memory bias interposed between an inside carrier location and the dart;

opening the carrier so that the memory bias displaces the dart so that the dart is exposed beyond the carrier;

manually grasping the exposed dart and manually separating the dart from the carrier.

10. The method according to claim 9 wherein the opening step comprises sliding a retaining cover form a carrier closing to a carrier opening position.

11. The method according to claim 9 wherein the manual grasping step comprises grasping the dart at a location other than at the flights, thereby removing the dart without damaging the flights.

* * * * *